US007306399B1

(12) United States Patent
Smith

(10) Patent No.: US 7,306,399 B1
(45) Date of Patent: Dec. 11, 2007

(54) STORMWATER CHAMBER WITH CHANGING CORRUGATION WIDTH ANGLE

(75) Inventor: Jonathan E. Smith, Waterford, CT (US)

(73) Assignee: Infiltrator Systems, Inc., Old Saybrook, CT (US)

( * ) Notice: Subject to any disclaimer, the term of this patent is extended or adjusted under 35 U.S.C. 154(b) by 105 days.

(21) Appl. No.: 11/441,664

(22) Filed: May 26, 2006
(Under 37 CFR 1.47)

Related U.S. Application Data

(63) Continuation-in-part of application No. 10/402,414, filed on Mar. 28, 2003, now Pat. No. 7,052,209, which is a continuation of application No. 09/849, 768, filed on May 24, 2001, now Pat. No. 7,118,306.

(60) Provisional application No. 60/202,255, filed on May 5, 2000, provisional application No. 60/368,764, filed on Mar. 29, 2002.

(51) Int. Cl.
*E02B 11/00* (2006.01)

(52) U.S. Cl. ..... 405/40; 405/46

(58) Field of Classification Search ..... 405/36, 405/43, 44, 45, 46, 49
See application file for complete search history.

(56) References Cited

U.S. PATENT DOCUMENTS

| | | | | |
|---|---|---|---|---|
| 4,759,661 | A * | 7/1988 | Nichols et al. | 405/49 |
| 5,336,017 | A * | 8/1994 | Nichols | 405/49 |
| 5,511,903 | A * | 4/1996 | Nichols et al. | 405/49 |
| 5,890,838 | A * | 4/1999 | Moore et al. | 405/49 |
| 6,129,482 | A * | 10/2000 | Ditullio | 405/49 |
| 6,322,288 | B1 * | 11/2001 | DiTullio | 405/49 |
| 7,118,306 | B2 * | 10/2006 | Kruger et al. | 405/49 |

* cited by examiner

*Primary Examiner*—Frederick L. Lagman
(74) *Attorney, Agent, or Firm*—C. Nessler; S. McHugh

(57) ABSTRACT

An arch shape cross section molded plastic stormwater chamber, which has a multiplicity of corrugations, can be nested within another like chamber for shipment. The width and included angle between the opposing sides of each corrugation both decrease with elevation from the base of the chamber.

8 Claims, 4 Drawing Sheets

STORMWATER CHAMBER WITH CHANGING CORRUGATION WIDTH ANGLE

This application is a continuation in part of patent application U.S. patent Ser. No. 10/402,414 of Kruger et al., filed Mar. 28, 2003 now U.S. Pat. No. 7,052,209, which is a continuation in part of patent application U.S. patent Ser. No. 09/849,768 of Krueger et al., filed May 24, 2001 now U.S. Pat. No. 7,118,306. This application claims benefit of provisional patent application Ser. No. 60/202,255, filed May 5, 2000 and of provisional patent application Ser. No. 60/368,764 filed Mar. 29, 2002.

TECHNICAL FIELD

The present invention relates to molded non-metal chambers for subsurface receipt and dispersal of waters, in particular to molded plastic chambers for receiving stormwater.

BACKGROUND

In use, a storm water chamber is buried beneath the surface of the earth, to collect storm water, such as runoff from parking lots and the like. In a typical stormwater chamber installation, a multiplicity of chambers is laid into cavities in the earth as large array, and then covered over with gravel, stone or soil. See U.S. Pat. Nos. 5,156,488, 5,511,903 and 5,890,838 for examples of chambers. Often the chambers are placed on and buried in gravel; and overlaid with more gravel or soil or a paved surface for motor vehicle traffic or parking. Thus, it is important that they be structurally sound. Chambers are nested one within the other for shipment. Thus, it is desirable that they nest closely together so that a given height stack has the largest possible number of chambers, so shipping costs can be minimized.

SUMMARY

An object of the invention is to provide stormwater chambers and related components which are strong, economic to produce, which nest well for shipping, which connect together well, and which are adapted for receiving internal flow control baffles.

In accord with the invention, an arch shape cross section chamber for receiving and dispersing stormwater when buried beneath the surface of the earth is corrugated and has a cross section geometry which is a continuous curve. Preferably, the curve is a truncated semi-ellipse, that is, less than half an ellipse, wherein the major axis of the ellipse lies along the vertical axis of the chamber. Thus, the vertical height of the chamber interior is less than half of the length of the major axis of the semi-ellipse of which the chamber geometry is a portion.

In accord with the invention, the widths of peak corrugations of the chamber vary with elevation from the base, when viewed from the side of the chamber, for good nesting. The included angle between the opposing sides of a peak width changes with elevation from the base, so that there are small angles near the top and larger angles near the base. Preferably, the opposing sides of each peak corrugation are elliptically curved to achieve such angle change. Compared to corrugations which have constant included angles between opposing sides, the width of the corrugation at the base is less, and thus good nesting is achieved without compromising the area of the base flange or the strength provided by corrugations.

In accord with the invention, a storm water chamber comprises a combination of standard corrugations along most of the length, in combination with smaller end corrugations, to enable joining of chambers in overlap fashion, as a string; and, sidewall base flanges which have turned up outer edges in combination with fins which connect said edges with the curved chamber sidewall.

In further accord with the invention, a domed end cap fits onto the end of the chamber to prevent gravel and soil from entering. A hole may be cut in the cap, so an input pipe can deliver water to the chamber. The cap and chamber are also shaped so the outer edge of the cap fits within the corrugations in the central part of the chamber, which corrugations are larger than those at one end. When so positioned, and when the dome has a cut out at an elevation substantially above the elevation of the base, water flow from one part of the chamber, or from one part of a series of interconnected chambers to another part, is inhibited.

The foregoing and other objects, features and advantages of the invention will become more apparent from the following description of preferred embodiments and accompanying drawings.

DESCRIPTION

An arch shape cross section chamber of the present invention is described in pending U.S. patent application Ser. No. 09/849,768 of Krueger et al., now U.S. Pat. No. 7,118,306. The disclosure and drawings thereof are hereby incorporated by reference. The present invention is also described in two provisional patent applications, namely Ser. No. 60/202,255, filed May 5, 2000, and Ser. No. 60/368,764 filed Mar. 29, 2003, the disclosures of which are hereby incorporated by reference.

In the incorporated references, the invention is variously referred to as a storm management system and, in part, as a corrugated stormwater chamber. A typical chamber may be 45-50 inch wide at the base by 30 inch high at the peak interior and 91 inch long. It is preferably made of injection molded high density polypropylene, or polyethylene or comparable material. Preferably it is made by injection molding, for precision, although other known methods of fabrication may alternatively be used.

Figure 1:
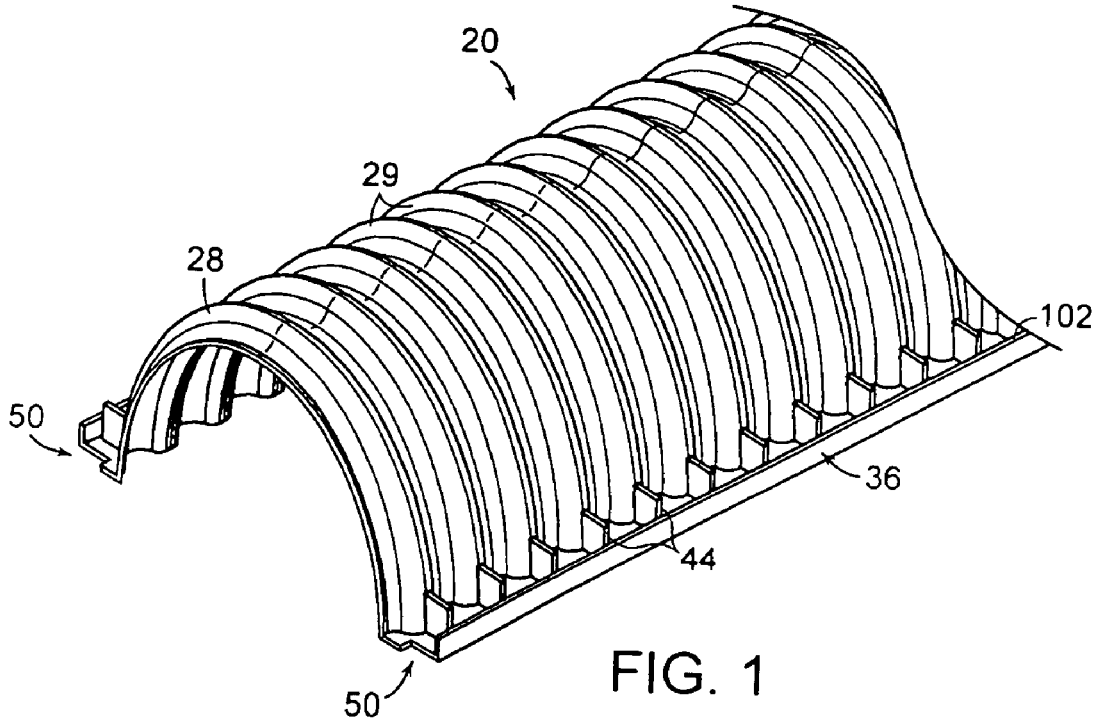
FIG. 1 is a partial isometric view of a molded plastic chamber.
Figure 2:
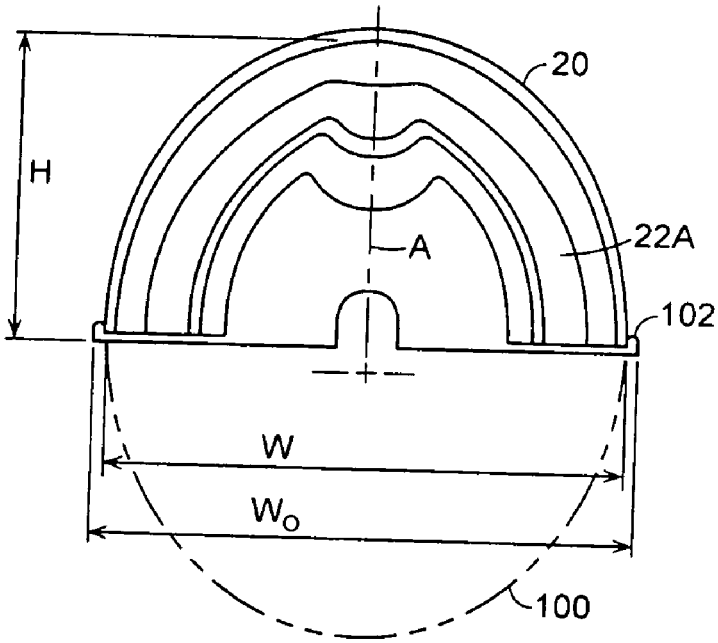
FIG. 2 is an end view of a chamber like that in FIG. 1, with an end plate attached at the end.

FIG. 1 shows a molded plastic chamber 20 having a continuous arch shape cross section and corrugations 29 running along the arch shape from opposing side base flanges 36. Preferably, the chamber has a continuous curve cross section geometry, for strength. More particularly, the chamber has a cross section geometry which is a truncated semi-ellipse, as illustrated by FIG. 2 (which shows an end plate 22A in place, which is discussed below). The geometry is less than half an ellipse 100, the major axis A of which lies along the vertical axis of the chamber. Thus, the vertical height is less than half of the length of the major axis of the semi-ellipse. As shown in FIG. 2, the chamber has an inner height H and an inner width W. Preferably, the chamber has a width to height ratio (W/H) between about 0.5 to 1 and 2 to 1, more preferably between 1 to 1 and 2 to 1. Preferably, the height H is between about 44 and 48 percent of the length of the major axis of the ellipse of which the truncated semi-ellipse is a portion.

Figure 3:
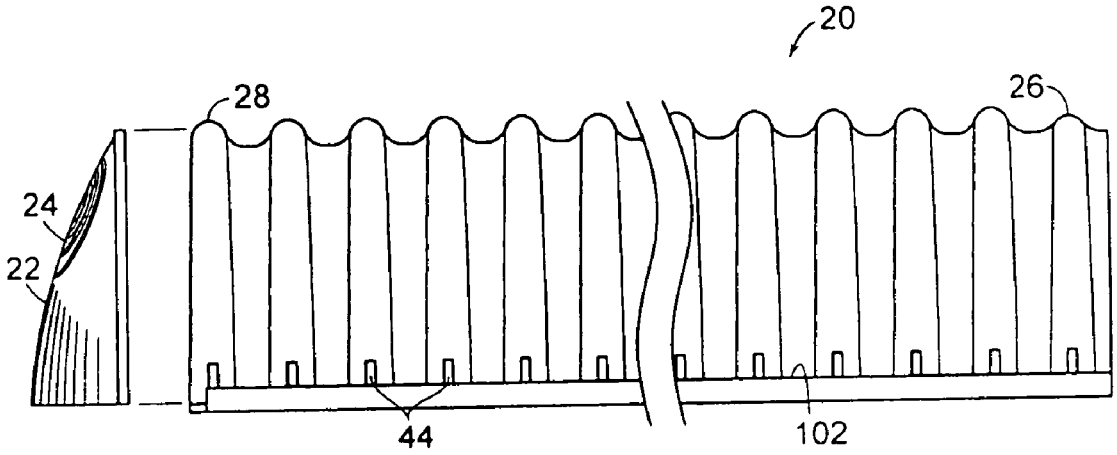
FIG. 3 is a side elevation view of a chamber with an end dome at one end.

The bulk of the body of the chamber has corrugations 29 of a standard dimension, including first end corrugation 28, except for at least a smaller second end corrugation 26. See FIG. 3. The difference in dimension between corrugation 26 and the "standard" corrugation 29, 28 is roughly equal or greater than the wall thickness of the chamber at the corrugations, which thickness will be typically in the range 0.150-0.188 inch for an injection molded chamber.

Figure 4:
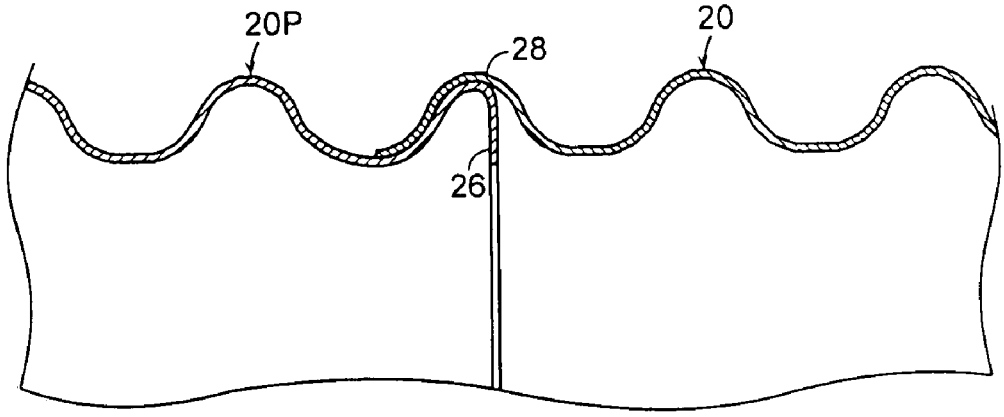
FIG. 4 is a fragmentary cross section of the joint formed between two mated chambers.

Thus, as shown in the partial vertical center-plane cross section of FIG. 4, the first end of a first chamber 20 can be laid on top of the second end of a second chamber 20P, so the chambers may thereby be joined together in the form a string of chambers. If a shorter chamber length is desired, as when a factory-made chamber is too long for the application, the chamber may be cut, for instance, at the midpoint in a valley. Thus the corrugation 29 which is at the newly cut end of the chamber can be engaged with the smaller corrugation 26 at the second end of another chamber, overlapping it, to form a joint.

The opposing side flanges 36 have turned up outer edges 102, called support members, for providing strength in the longitudinal direction. See FIG. 5. The flanges 36 have cutout portions 50 at one end, where the large corrugation 28 is. See FIG. 1. Thus, when chambers are overlapped to form a string, the flanges 36 of the small end fit within the cutouts, and the chambers better fit together, than would be the case without the cutouts.

Figure 6:
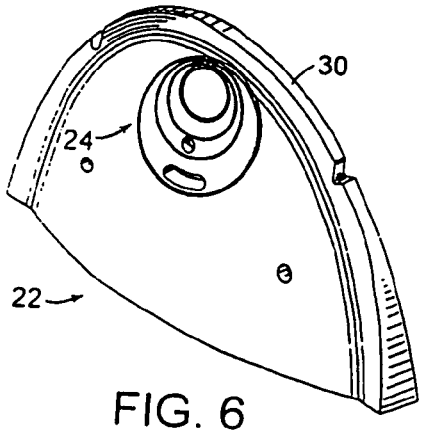
FIG. 6 is an isometric view of an end plate, referred to as an end dome.
Figure 7:
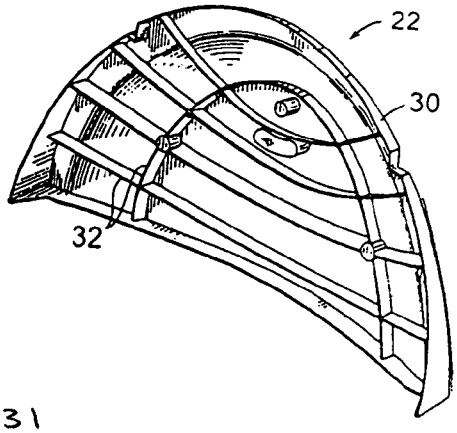
FIG. 7 is an isometric view of the interior of the end plate of FIG. 6.

An end plate 22, called an end dome here, is shown in FIGS. 6 and 7. How it engages and closes the open end of a chamber is shown in the side elevation view of FIG. 3. The end dome 22 has a dished or convex shape (viewed from the exterior of the chamber, when installed). Compared to the essentially flat end plates of the prior art, the end dome 22 has improved resistance to the load of encompassing compactable medium such as crushed stone or soil which impinges on the dome when the chamber is buried and in use. The dished shape also provides more volume to the interior of a chamber than does a flat end.

FIG. 7 shows how the interior of the dome has a cross hatch ribbing 32, to provide further strength to the dished portion. The arch shape flange 30 of the end dome has an outer dimension which is less than or equal to the outside dimension of a smaller corrugation 26 of the chamber. Thus, the flange 30 slips within corrugation 28 at the first end of the chamber 24, just as does the smaller corrugation 26 of another chamber. Preferably, the fit of flange 30 at end corrugation 28 is intentionally looser than the fit of the smaller corrugation 26, to the extent that the flange will also fit within the smaller opposing end corrugation 26 of a chamber. Thus only one design end dome is needed for closing both ends of chamber 20, with its differing dimension end corrugations. In the generality of the invention, the end dome described here can be used on other kinds of chambers.

The end dome 20 can also fit within any of the other corrugations of the chamber 20, along the chamber length. Thus, if the chamber 20 is cut at any point along its length, to form a shortened length chamber, the end dome can be used as a closure at the cut end. The dome 22 has scoring 24 which enable circular cutouts, to enable a pipe to deliver water to the interior of chamber(s).

When soil pushes on the dome end plate 22, there is a lateral outward force, as the dome tries to flatten. So, the loose fit referred to above is not so loose as to prevent the dome flange or periphery from engaging the inside of a chamber corrugation and pushing outwardly on it. Since the chamber is backed by soil or stone lying along the length of the chamber, the chamber in vicinity of said corrugation resists the outward force. Thus, the dome endplate in the invention provides substantially greater strength and stiffness than does a flat end plate.

An extra dome 22 with a through hole can be positioned at any point along the length of the chamber, to provide a baffle or act as a weir. In such use the dome may have a cutout at an elevation. Because of the kind of fit mentioned above, there can be flow through the gap between the end dome and chamber corrugation, so the end dome acts as a weir. If it is desired to prevent such, appropriate sealant or gasketing can be employed. Using a dome-as-weir creates subchambers within the length of a chamber. More than one dome may be positioned along the length of a chamber to create a multiplicity of subchambers. The dome-as-weir is used to make the subchamber function as a reservoir and settlement basin. Thus, water flowing along the length of the chamber will stagnate in velocity and desirable settling of entrained debris will be realized. Thus, by strategic placement of dome-weirs along the length of the chamber near the inlet end of a string of chambers, a preferential region for settlement of heavier than water debris is created. Cleaning is made easier. While the dome shaped end plate is preferred when a weir is desired, in the generality of this aspect of the invention, flat end plates may be used as weirs.

Chamber 20 has another feature which, in preferred embodiment, is characterized by an approximate or exact elliptical curve. This feature, corrugation width, is appreciated when the chamber is viewed from the side in elevation, as is the portion of the chamber shown in FIG. 8. The width W of each of each corrugation 29 varies with elevation from the base; and preferably that is accomplished by shaping each opposing side 35 of the corrugation so it has the shape of a segment of an elliptical curve 40. The shape and location of the elliptical curve segment in space relative to the chamber base 36 is selected so that the width of each corrugation 29 narrows as it runs toward the top 42 of the corrugation. In the invention, at any given point along the corrugation, as it rises from the base to the top, there is an angle L between the opposing sides. See FIG. 8. The angle L is that which is projected into the vertical plane. Each opposing side 35 of the corrugation has a slope L/2 relative to the vertical cross section plane. In understanding how the angle L varies in the invention, to accomplish good nesting, it should be appreciated that each corrugation recedes from the viewer in the picture, as it curves toward the top. (The sides of each corrugation also run in the chamber lengthwise direction, as the sides run into valleys 31 between the corrugations. In that direction, the sides slope along angle θ, which at the top of the chamber is preferably about 8-10 degrees.)

Figure 8:
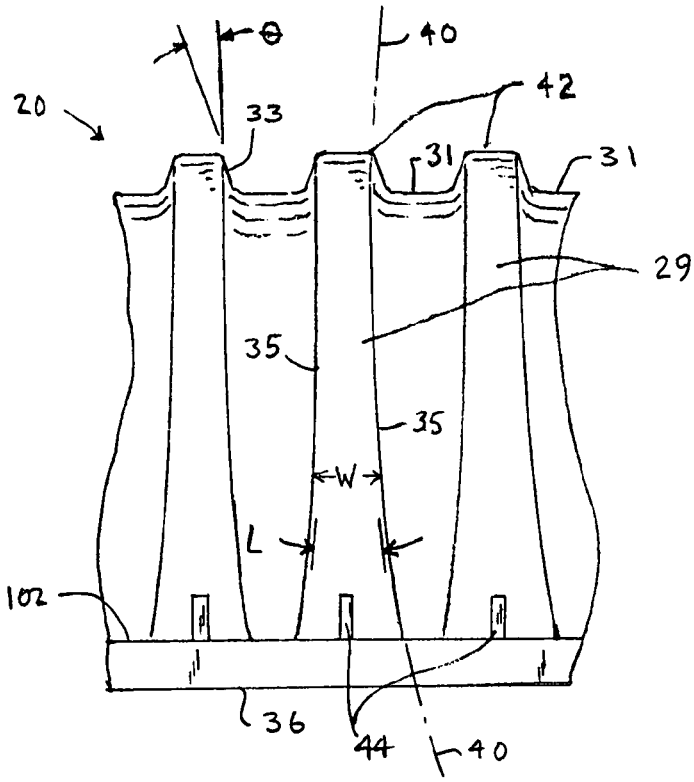
FIG. 8 is a side elevation view of a portion of a chamber, showing how corrugation width changes with elevation.
Figure 9:
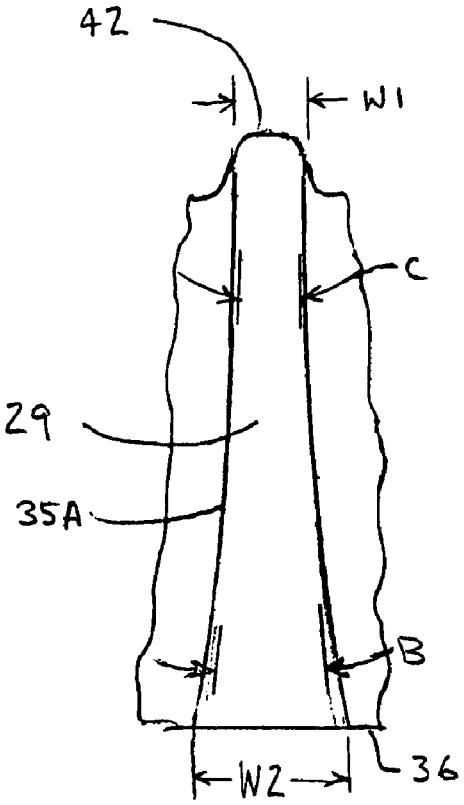
FIG. 9 is a side elevation view of one peak corrugation, to illustrate details of the width change.
Figure 10:
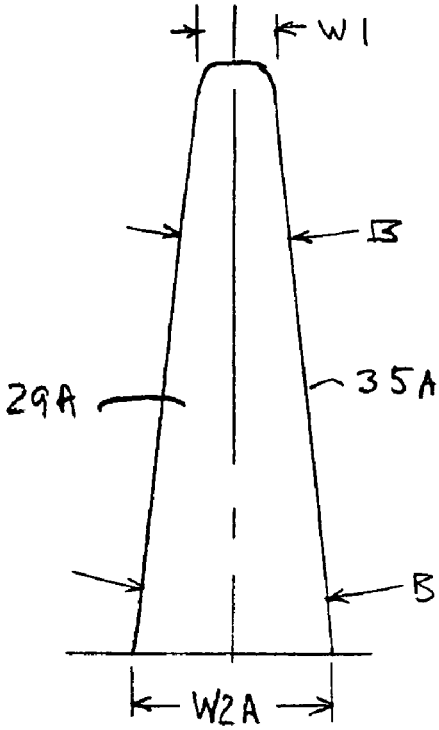
FIG. 10 PRIOR ART
FIG. 10 is a view like FIG. 9, showing for comparison a peak corrugation which has straight sides

FIGS. 9 and 10 are similar to FIG. 8, but shows only one corrugation. FIG. 9 further illustrates how the included angle L between the opposing sides 35 of the corrugation 29 decreases with elevation from the base. In FIG. 9 two representative included angles are shown: angle B near the base 36 of the chamber; and, angle C near the top of the corrugation. In an example of the invention, for a chamber having a height of about 16-20 inches, the included angle B near the base might be about 11 degrees, while the included angle C might be about 5 degrees. Corrugation 29 has a top width of W1 and a bottom width of W2.

FIG. 10 shows a prior art corrugation 29A, which has an included angle which is constant with elevation at angle B, as in the prior art. Corrugation 29A has the same top width W1 as does the corrugation 29 of FIG. 9. Such width is required for strength. For nesting, chambers must have sloping surfaces. As is well known, there is a critical or threshold angle of sloping which is necessary to obtain so called line contact, which enables objects such as pots, pails, etc, to nest "perfectly". The critical angle is a function of the thickness of the objects being nested. In a chamber that concept is applied on a practical basis to the corrugations near the base of the chamber. At that point corrugations rise near vertically from the base. Assume that to get satisfactory nesting there, the opposing sides must slope at an included angle B. So, in the case of the prior art corrugation 29A, given the minimum width W1 and a constant angle B, that dictates a corrugation width W2A at the bottom of the chamber, as shown in FIG. 10. In contrast, with the invention, since angles C near the top are less than angle B near the bottom, a smaller width W2 is enabled. The smaller width results in less reduction in the surface area of the flange which is available for supporting the chamber during use; or alternatively, for closer spacing of corrugations than would otherwise be possible.

A preferred way of carrying out the invention is to have angle L vary continuously with elevation, by having elliptical curve shaped opposing sides 35 of the corrugations. Alternately, series of differently angled segments can be provided along the rise of each edge 35, where each segment has a progressively smaller angle to the vertical with elevation. Other than elliptical curve functions can be followed or approximated, to provide a progressive decrease of included angle with elevation.

Figure 5:
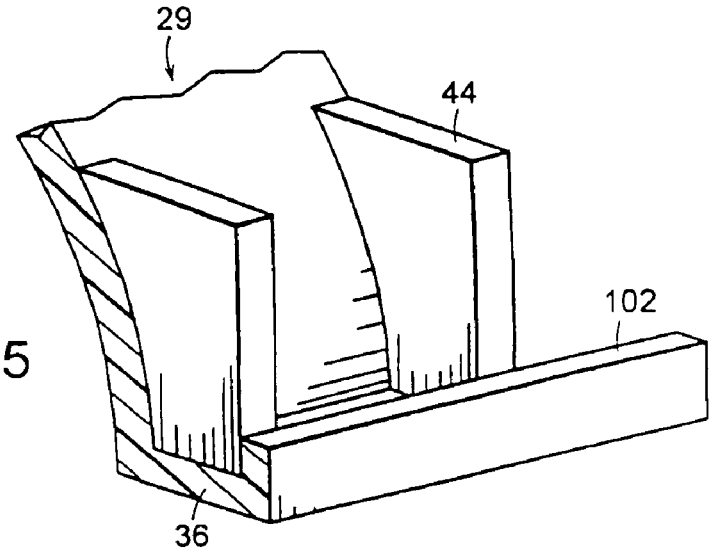
FIG. 5 is a fragmentary isometric view of the end of the chamber of FIG. 1, to illustrate details at the base of the chamber sidewall.

In another aspect of the invention, the chamber has vertical standoffs in the form of fins 44, also called connecting elements, which are spaced apart along the opposing side base flanges 36. Fins 44 connect outer edges 102 with the nearby curved chamber sidewall, to provide support to the flanges in the direction normal to the length of the chamber. See FIG. 5 and FIG. 1. The height of the fins is chosen to prevent the chambers from jamming one onto the other. As shown in FIG. 5, preferably two spaced apart fins 44 run to each corrugation.

The inventions may be applied to chambers that have configurations other than the exemplary chambers; and, they may be applied to chambers used for other purposes than receiving and dispersing stormwater. For instance, the inventions may be applied to wastewater leaching chambers and to other arch like devices adapted for dispersing or gathering waters into or from soil and granular media.

Although this invention has been shown and described with respect to a preferred embodiment, it will be understood by those skilled in this art that various changes in form and detail thereof may be made without departing from the spirit and scope of the claimed invention.

I claim:

1. A corrugated arch shape cross section chamber for receiving and dispersing storm water or wastewater, having opposing side base flanges and a multiplicity of corrugations running upwardly from the base flanges to the top of the chamber; wherein each of corrugation has opposing sides; and wherein the corrugation width between said opposing sides and the included angle between said opposing sides both decrease with elevation from the base flange.

2. The chamber of claim 1 wherein the each opposing corrugation side runs along an elliptical curve path.

3. The chamber of claim 1 wherein the chamber has a continuous curve cross section.

4. The chamber of claim 1 made of molded plastic.

5. In a arch shape cross section chamber, for receiving and dispersing stormwater or wastewater, of the type having opposing side base flanges, a continuous curve cross section, and a multiplicity of corrugations running along the curve of the arch shape, wherein when the chamber is viewed in side elevation, each corrugation has opposing sides which angle toward one another, so that the width therebetween decreases with elevation from the base flange, the improvement which comprises: each corrugation having an included angle between opposing sides which decreases with elevation from the base.

6. The chamber of claim 5 wherein the each opposing corrugation side runs along an elliptical curve path.

7. The chamber of claim 5 wherein the chamber has a continuous curve cross section.

8. The chamber of claim 5 made of molded plastic.

* * * * *